US006525271B2

(12) United States Patent
Groegl et al.

(10) Patent No.: US 6,525,271 B2
(45) Date of Patent: Feb. 25, 2003

(54) FLEXIBLE ELECTRICAL CABLE

(75) Inventors: Ferdinand Groegl, Nuremberg (DE); Thomas Mann, Weissenohe (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/046,900

(22) Filed: Jan. 17, 2002

(65) Prior Publication Data

US 2002/0092668 A1 Jul. 18, 2002

(30) Foreign Application Priority Data

Jan. 18, 2001 (DE) ..... 201 00 911 U

(51) Int. Cl.[7] ..... H01B 7/04
(52) U.S. Cl. ..... 174/105 R
(58) Field of Search ..... 174/113 R, 105 R, 174/102 R, 106 R, 122 R, 124 R

(56) References Cited

U.S. PATENT DOCUMENTS 3,676,576 A * 7/1972 Dubernet et al. ..... 174/113 R
4,034,138 A * 7/1977 Babayan ..... 428/378
4,600,806 A * 7/1986 Beretta ..... 174/113 R
4,657,342 A * 4/1987 Bauer ..... 174/115
4,707,569 A * 11/1987 Yoshimura et al. ..... 174/110 F
5,133,034 A * 7/1992 Arroyo et al. ..... 174/23 C
5,750,930 A * 5/1998 Buck et al. ..... 174/102 R

FOREIGN PATENT DOCUMENTS

| | | |
|---|---|---|
| DE | 79 17 621 | 9/1979 |
| DE | 34 05 852 A1 | 8/1985 |
| DE | 36 04 311 A1 | 8/1987 |
| DE | 32 20 392 C2 | 10/1987 |
| DE | 36 36 321 A1 | 4/1988 |
| DE | 42 18 707 C1 | 4/1993 |
| DE | 42 20 614 A1 | 1/1994 |
| DE | 93 19 131.6 | 8/1994 |
| DE | 199 14 924 A1 | 10/2000 |

OTHER PUBLICATIONS

Hawley, "Condensed Chemical Dictionary", 1981.*

* cited by examiner

*Primary Examiner*—Chau N. Nguyen
(74) *Attorney, Agent, or Firm*—Sughrue Mion, PLLC

(57) ABSTRACT

A flexible electrical cable is formed of a cable core made of a plurality of insulated conductors (2, 3, 4, 5, 6, 7) that are stranded together, an inner sheath (13) that fills up the interstices between strands, a wrapping (14) resting on the inner sheath (13), armor braiding (15) with a 30%–80% optical coverage, and a plastic outer sheath (16) penetrating the interstices between the braiding (15).

9 Claims, 1 Drawing Sheet

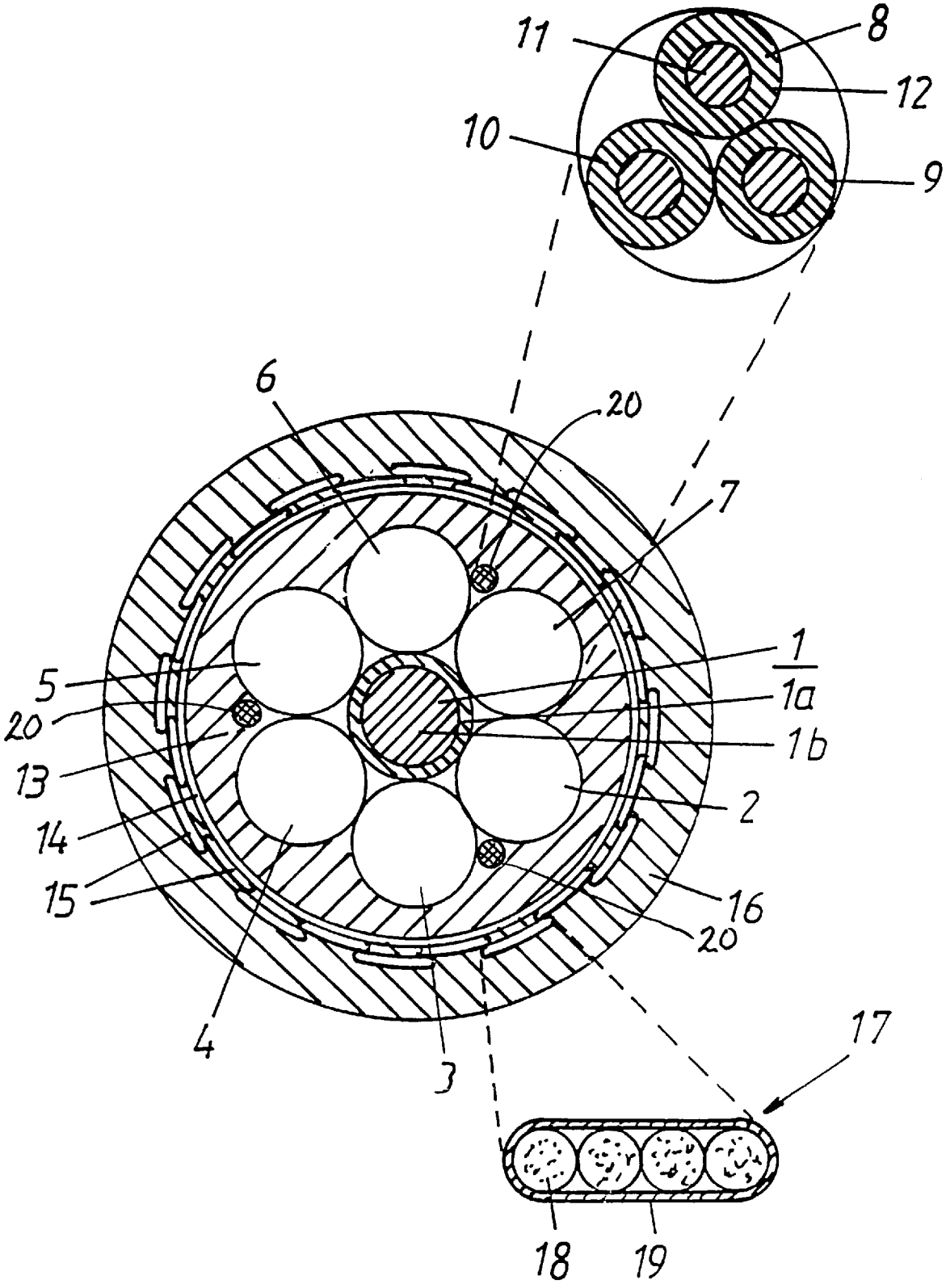
11
8
12
10
9
6
20
7
1
1a
1b
5
20
13
14
15
2
16
20
4
3
17
18
19

FLEXIBLE ELECTRICAL CABLE

This application is based on and claims the benefit of German Patent Application No. 201 00 911.0 filed Jan. 18, 2001, which is incorporated by reference herein.

BACKGROUND OF THE INVENTION

The invention relates to a flexible electrical cable with a cable core made of a plurality of insulated conductors that are stranded together, and surrounded by at least one sheath.

Such flexible electrical cables are used, for instance, as elevator cables or as so-called drag chain cables. During operation of corresponding equipment, the cables are continually moved in special drag chains. The cables are either shielded or unshielded. The shielded version is used particularly to meet special electromagnetic compatibility requirements.

The complete energy and information supply of industrial equipment and machine tools has thus far been effected via drag cables that are individually installed in so-called drag chains.

In the past, the maximum chain length was 6 meters with motion rates of 180 m/min and general acceleration rates of 2 m/sec$^2$. A technology with substantially improved drag chain construction, which is already practiced today in extreme applications, permits speeds of up to 500 m/min with motion lengths of up to 50 m and acceleration rates of 8 m/sec$^2$ and more.

One solution, which is practiced to meet extreme requirements, consists of a flat cable construction with laterally arranged steel cables. Such a cable requires more space.

Another solution provides for the typical round construction of the cable, in which the sheath consists of a so-called steel/polyurethane composite construction. The drawback of this cable is the poor connection of the carrier element to the drag chain and the more difficult cable preparation and termination.

Under extremely difficult conditions, the known cables fail due to so-called corkscrew formation. This causes substantial downtime of the industrial equipment.

SUMMARY OF THE INVENTION

The object of the present invention is to provide a flexible electrical cable for extreme requirements, which is suitable for traversing distances of more than 30 meters at speeds of up to 500 m/min and acceleration or deceleration rates of up to 10 m/sec$^2$. In addition, the cable is to be simple to prepare and terminate.

This object is attained by a flexible electrical cable with a cable core made of a plurality of insulated conductors that are stranded together, an inner sheath filling up the interstices between strands, a wrapping resting on the inner sheath, an armor braiding with an optical coverage of 30%–80% and a plastic outer sheath penetrating the interstices of the armor braiding.

Further advantageous embodiments of the invention will be clear from the detailed description below in conjunction with the appended claims.

BRIEF DESCRIPTION OF THE DRAWINGS

The invention will now be described in greater detail, by way of example, with the aid of the embodiment schematically depicted in FIG. 1 which shows a central element made of a steel cable 1*a* and a compressible sleeve 1*b* located over the steel cable 1*a*, e.g., a wrapping of so-called flock yarns.

DETAILED DESCRIPTION OF THE INVENTION

Twisted around this central element 1 are six strand bundles 2, 3, 4, 5, 6 and 7, each of which consists of three strands 8, 9 and 10. Each strand comprises a conductor 11, e.g., a litz wire, and insulation 12, e.g., a two-layer insulation as described in German patent application 100 36 610.4 dated Jul. 27, 2000.

Arranged over the stranding layer, which is formed by the strand bundles 2, 3, 4, 5, 6 and 7, is an inner sheath 13, e.g., made of thermoplastic polyurethane, which fills up the interstices between the strand bundles.

Instead of the central element 1—or often also in addition thereto—long elements 20 which are stable to tensile and compressive stresses may be provided in the interstices.

The inner sheath 13 is surrounded by a wrapping 14, which preferably consists of a nonwoven tape.

Arranged over said wrapping 14 is an armor braiding 15, which is applied at an optical coverage of 30%–80%, so that the material of the outer sheath 16 can penetrate the armor braiding 15 up to the tape wrapping 14. The outer sheath 16 and armor braiding 15 form a unit, which can be easily lifted off from the inner sheath 13 or the wrapping 14 to prepare and terminate the cable ends.

The elements 17 forming the armor braiding 15 are preferably flat elements, which are highly flexible but nevertheless stable to tensile and compressive stresses.

The flat element 17 comprises four long objects 18 arranged side by side, which are jointly surrounded by a plastic sheath 19, preferably made of polyamide.

Objects 18 are either multiple-wound steel wires, or flat polyamide fibers extending in a matrix, or fiber bundles made of polyaramide (Kevlar), glass or carbon fiber. Particularly advantageously, the outer sheath 16 is made of an extruded thermoplastic polyurethane.

What is claimed is:

1. A flexible electrical cable with a cable core made of a plurality of insulated conductors (2, 3, 4, 5, 6, 7) that are stranded together, an inner sheath (13) filling up the interstices between strands, a wrapping (14) resting on the inner sheath (13), an armor braiding (15) with an optical coverage of 30%–80% and a plastic outer sheath (16) penetrating the interstices of the armor braiding (15), wherein the armor braiding is made of armor elements (17) which are formed by a plurality of steel wires arranged side by side or polyaramide fibers embedded in a polyamide matrix and surrounded by a sheath (19) of plastic material.

2. A flexible cable as claimed in claim 1, characterized in that the conductors (2) are unit-stranded with an optimized twist.

3. A flexible cable as claimed in claim 1, characterized in that the conductors are stranded with an optimized twist onto a central core element (1) that is stable to tensile and compressive stresses.

4. A flexible cable as claimed in claim 1, characterized in that long elements that are stable to tensile and compressive stresses are arranged in the stranding interstices.

5. A flexible cable as claimed claim 1, characterized in that the inner sheath (13) is made of thermoplastic polyurethane.

6. A flexible cable as claimed in claim 1, characterized in that the core element (1), which is stable to tensile and compressive stresses, is a steel cable (1*a*) with a compressible sheath (1*b*).

7. A flexible cable as claimed in claim 1, characterized in that the wrapping (14) is made of a nonwoven material.

8. A flexible cable as claimed in claim 1, characterized in that the outer sheath (16) is made of thermoplastic polyurethane.

9. The flexible cable as claimed in claim 1, characterized in that said sheath of plastic material is a polyamide sheath.

* * * * *